US010935352B1

(12) United States Patent
Nance et al.

(10) Patent No.: US 10,935,352 B1
(45) Date of Patent: Mar. 2, 2021

(54) INITIATION SYSTEM HAVING PLASTIC HOUSING, WHICH ENCAPSULATES AN INITIATOR, AND A LID THAT HERMETICALLY SEALS THE HOUSING

(71) Applicant: Reynolds Systems, Inc., Middletown, CA (US)

(72) Inventors: Nicholas C. Nance, Middletown, CA (US); Michael A. Amendola, Middletown, CA (US); Christopher J. Nance, Middletown, CA (US)

(73) Assignee: Reynolds Systems, Inc., Middletown, CA (US)

( * ) Notice: Subject to any disclaimer, the term of this patent is extended or adjusted under 35 U.S.C. 154(b) by 0 days.

(21) Appl. No.: 17/005,878

(22) Filed: Aug. 28, 2020

Related U.S. Application Data

(62) Division of application No. 16/266,124, filed on Feb. 4, 2019, now Pat. No. 10,794,670.

(51) Int. Cl.
*F42B 3/12* (2006.01)

(52) U.S. Cl.
CPC ..... *F42B 3/125* (2013.01); *F42B 3/124* (2013.01)

(58) Field of Classification Search
CPC .. F42B 3/12; F42B 3/125; F42B 3/124; F42B 3/13
USPC ..... 102/202.14, 202.7, 202.5
See application file for complete search history.

(56) References Cited

U.S. PATENT DOCUMENTS

| | | | |
|---|---|---|---|
| 7,690,303 | B2 | 4/2010 | Reynolds et al. |
| 7,748,322 | B1 | 7/2010 | Reynolds et al. |
| 7,921,774 | B1 | 4/2011 | Reynolds et al. |
| 7,987,787 | B1 | 8/2011 | Sudick |
| 8,100,043 | B1 | 1/2012 | Nance et al. |
| 8,196,512 | B1 | 6/2012 | Reynolds et al. |
| 8,210,083 | B1 | 7/2012 | Nance et al. |
| 10,267,604 | B1 | 4/2019 | Morales et al. |
| 10,267,605 | B1 | 4/2019 | Meadows |

FOREIGN PATENT DOCUMENTS

EP 0805334 A1 * 11/1997 ..... F42B 3/125

* cited by examiner

*Primary Examiner* — Reginald S Tillman, Jr.
(74) *Attorney, Agent, or Firm* — Burris Law, PLLC

(57) ABSTRACT

An initiation system that includes an initiator chip having an electrically conductive bridge, a flyer layer coupled to the initiator chip and overlying the bridge, a housing, an energetic material and a lid. The housing is formed of a first plastic material that is overmolded onto the initiator chip such that the initiator chip is at least partly encapsulated into the first plastic material to thereby fixedly couple the initiator chip to the housing. The housing defines a cavity having a first end and a second, open end that is opposite the first end. The initiator chip is disposed proximate the first end of the cavity. The energetic material is disposed in the cavity. The lid is at least partly formed of a second plastic material and is fixedly and sealingly coupled to the housing to close the open end of the cavity.

21 Claims, 9 Drawing Sheets

INITIATION SYSTEM HAVING PLASTIC HOUSING, WHICH ENCAPSULATES AN INITIATOR, AND A LID THAT HERMETICALLY SEALS THE HOUSING

CROSS-REFERENCE TO RELATED APPLICATIONS

This application is a divisional application of U.S. application Ser. No. 16/266,124 filed on Feb. 4, 2019, the disclosure of which is incorporated by reference as if fully set forth in detail herein.

FIELD

The present disclosure relates to an initiation system and more particularly to an initiation system having a plastic housing, which encapsulates an initiator, and a lid that hermetically seals the housing.

BACKGROUND

This section provides background information related to the present disclosure which is not necessarily prior art.

U.S. Pat. No. 7,690,303, which is incorporated by reference as if fully set forth in detail herein, discloses an initiation system having a housing that is formed of plastic and which is molded over a type of initiator that employs a foil bridge. A secondary explosive is received into a cavity in the housing and detonates in response to the operation of the initiator. While this initiation system is satisfactory for its intended purpose, the cover that is secured to the housing to retain the secondary explosive within the cavity is not hermetically sealed to the plastic housing. Consequently, it is possible for moisture to enter the cavity and degrade the secondary explosive.

SUMMARY

This section provides a general summary of the disclosure, and is not a comprehensive disclosure of its full scope or all of its features.

In one form, the present disclosure provides an initiation system that includes a housing, an exploding foil initiator and a securing structure. The housing is formed of plastic and defines a cavity with an open end. The exploding foil initiator assembly has an initiator chip, a flyer layer and a barrel. The initiator chip has an electrically conductive bridge and is at least partly encapsulated in the plastic of the housing. The flyer layer has a first side, which faces the bridge, and a second side opposite the first side. The barrel is disposed between the second side of the flyer layer and an end of the cavity opposite the open end. The securing structure is formed of metal and is partly encapsulated in the plastic of the housing. The securing structure is disposed about the cavity and extends away from the housing about a perimeter of the open end of the cavity.

In another form, the present disclosure provides an initiation system that includes an initiator chip, a flyer layer, a securing structure and a housing. The initiator chip has an electrically conductive bridge. The flyer layer is coupled to the initiator chip and overlies the bridge. The securing structure is formed of metal and has a housing mount portion and a lid mount portion. The housing is formed of a plastic material that is overmolded onto the initiator chip and the housing mount portion such that the initiator chip and the housing mount portion are at least partly encapsulated into the plastic material to fixedly couple the initiator chip and the securing structure to the housing. The housing defines a cavity with a first end and a second, open end. The initiator chip is disposed proximate the first end of the cavity. The lid mount portion extends outwardly from the housing and is disposed about a perimeter of the second end of the cavity.

In still another form, the present disclosure provides an initiation system that includes an initiator chip having an electrically conductive bridge, a flyer layer coupled to the initiator chip and overlying the bridge, a housing, an energetic material and a lid. The housing is formed of a first plastic material that is overmolded onto the initiator chip such that the initiator chip is at least partly encapsulated into the first plastic material to thereby fixedly couple the initiator chip to the housing. The housing defines a cavity having a first end and a second, open end that is opposite the first end. The initiator chip is disposed proximate the first end of the cavity. The energetic material is disposed in the cavity. The lid is at least partly formed of a second plastic material and is fixedly and sealingly coupled to the housing to close the open end of the cavity.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
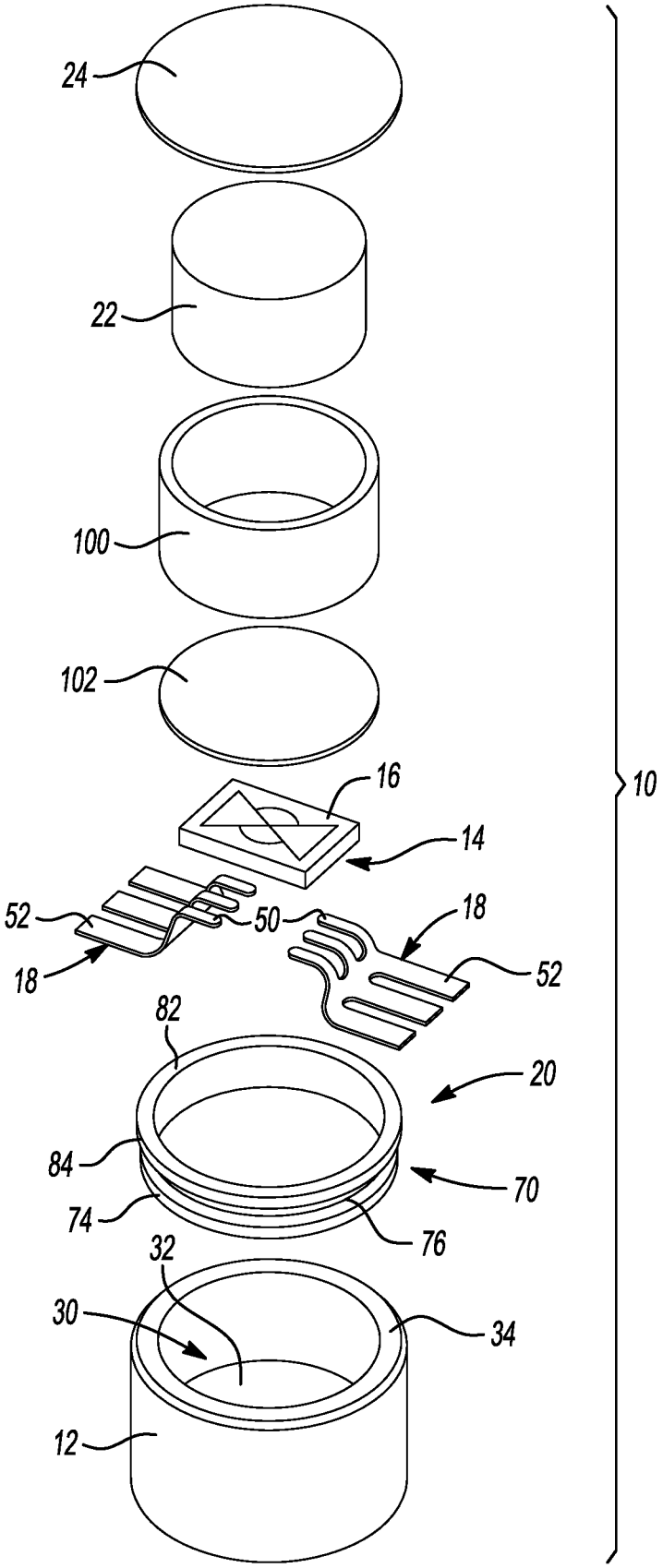
FIG. 1 is an exploded perspective view of an exemplary initiation system constructed in accordance with the teachings of the present disclosure.
Figure 2:
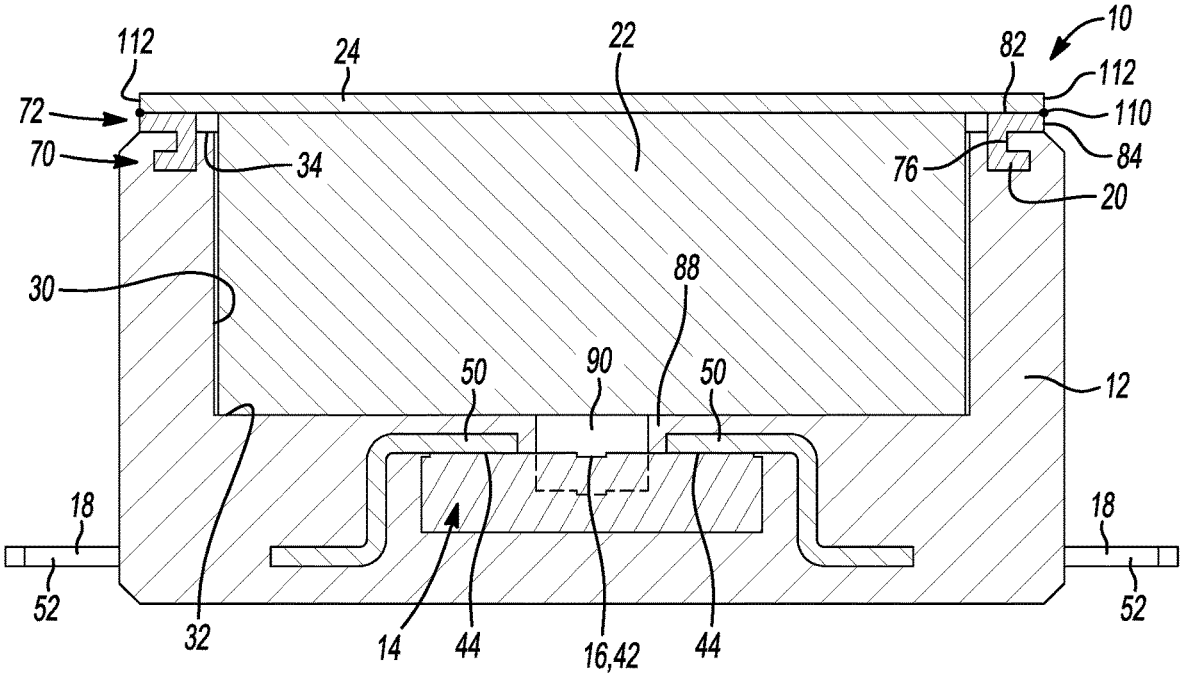
FIG. 2 is a section view of the initiation system of FIG. 1.

With reference to FIGS. 1 and 2 of the drawings, an initiation system constructed in accordance with the teachings of the present disclosure is generally indicated by reference numeral 10. The initiation system 10 is illustrated as being a detonator that is employed to initiate detonation of a primary charge (not shown) that is formed of an energetic material (not shown), but it will be appreciated that an initiation system constructed in accordance with the teachings of the present disclosure could be employed to initiate combustion and/or deflagration in a primary charge formed of an energetic material. The initiation system 10 can include a housing 12, an initiator chip 14, a flyer layer 16, a plurality of initiator conductors 18, a securing structure 20, an input charge 22 and a lid 24.

The housing 12 can be formed of an appropriate plastic material, such as polycarbonate, acrylic or ABS, in a suitable injection molding process. The housing 12 can define a cavity 30 having a first end 32 and a second, open end 34 that is opposite the first end 32.

Figure 3:
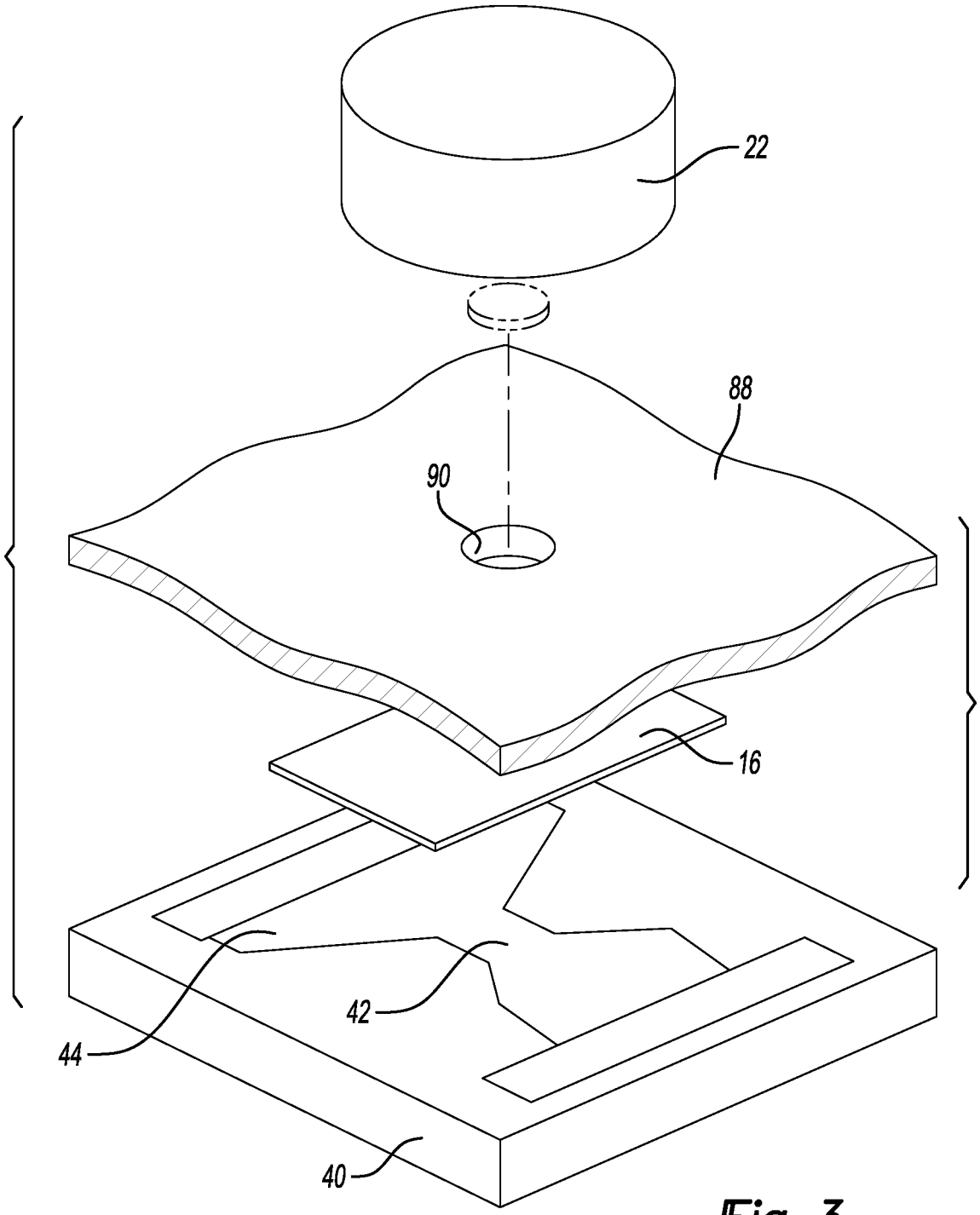
FIG. 3 is an exploded perspective view of a portion of the initiation system of FIG. 1 illustrating an initiator chip, a flyer layer and barrel and an input charge.

In the example provided, the initiator chip 14 is a part of an exploding foil initiator, which is configured to initiate a detonation event in the input charge 22 when the initiator chip 14 is operated. As shown in FIG. 3, the initiator chip 14 can comprise an electrically non-conductive substrate 40, a bridge 42 and a pair of bridge contacts 44. The bridge 42 and the bridge contacts 44 can be formed of one or more layers of one or more types of metal that can be vapor deposited onto the substrate 40. It will be appreciated, however, that the initiator chip 14 can be any type of device for initiating a combustion event, a deflagration event, an explosion event or a detonation event and could be electronically-actuator or passively activated. Examples of other suitable initiator chips include exploding bridge wire initiators, squibs, SCB semi-conductor bridge devices and thin film bridge initiators.

The flyer layer 16 can be formed of a suitable material, such as polyamide, and can be mounted to the initiator chip 14 so as to overlie and abut the bridge 42.

Figure 4:
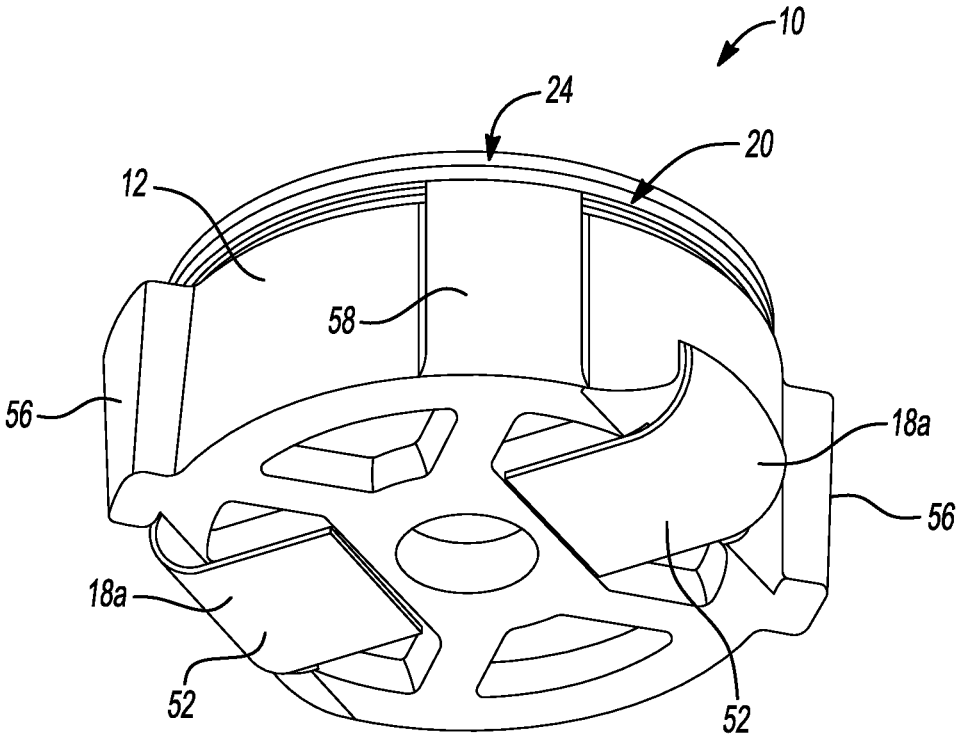
FIG. 4 is a perspective view of another initiation system constructed in accordance with the teachings of the present disclosure.
Figure 5:
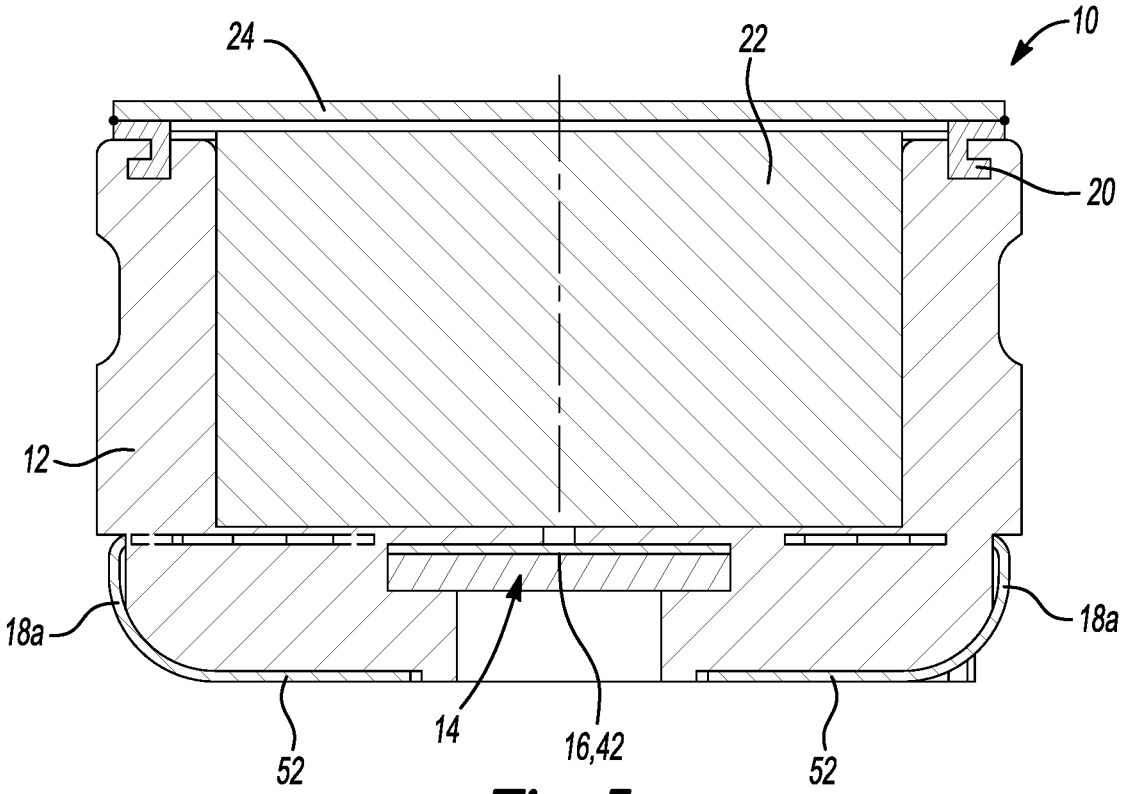
FIG. 5 is a section view of the initiation system of FIG. 4.
Figure 6:
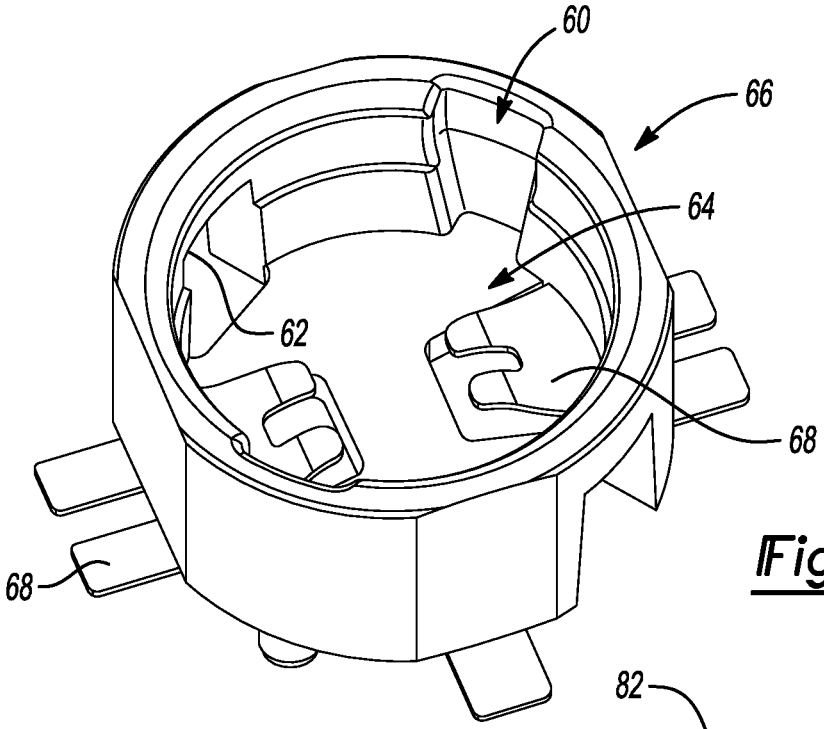
FIG. 6 is a perspective view of a secondary housing that is configured to receive the initiation system of FIG. 4 in a snap-fit manner.

Returning to FIGS. 1 and 2, the initiator conductors 18 can be formed of one or more electrically conductive materials and have first ends 50, which are each mounted and electrically coupled to an associated one of the bridge contacts 44, and a second end 34. In the example provided, the second ends 52 of the initiator conductors 18 are configured to be surface mounted to a circuit board (not shown) in a fire set assembly (not shown). It will be appreciated, however, that the initiator conductors 18 could be shaped differently. In the example of FIGS. 4 and 5, the second ends 52 of the initiator conductors 18*a* are shaped as flat or leaf springs. In this example, the housing 12 can be configured in a manner described in U.S. Pat. No. 8,210,083. With additional reference to FIG. 6, a plurality of insertion guides 56 and locking projections 58 on the housing 12 can matingly engage with insertion guides 60 and locking members 62, respectively in a socket 64 of a mating secondary housing 66 to permit the housing 12 to be received in the socket 64 and engage the secondary housing 66 in a snap-fit manner. It will be appreciated that receipt housing 12 into the secondary housing 66 in a snap-fit manner simultaneously electrically couples the second ends 52 of the initiator conductors 18*a* to auxiliary conductors 68 that are mounted to the secondary housing 66 and extend into the socket 64.

Figure 7:
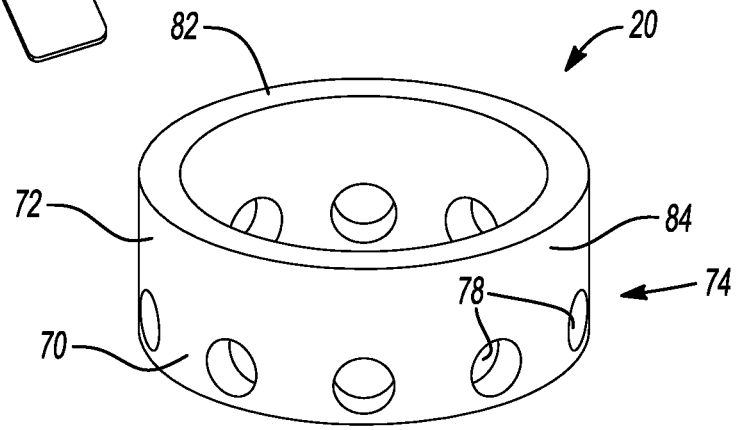
FIG. 7 is a perspective view of an alternately configured securing structure.
Figure 8:
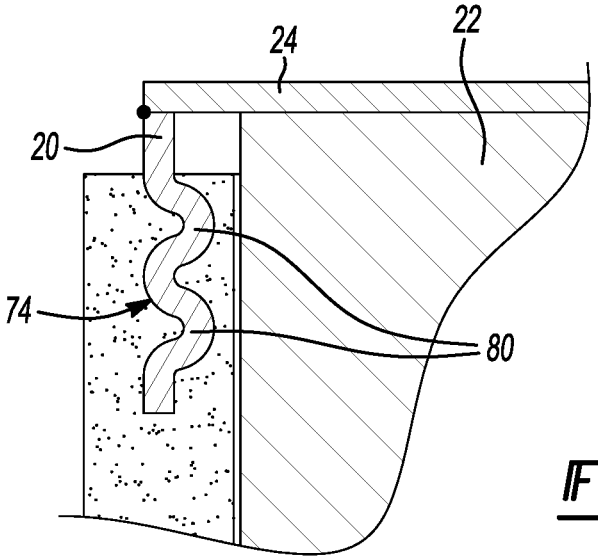
FIG. 8 is a section view of a portion of another initiation system having yet another alternately configured securing structure.

Returning to FIGS. 1 and 2, the securing structure 20 can be a hollow, (e.g., annular) structure that can be formed of a suitable material, such as aluminum or steel, and can include a housing mount portion 70 and a lid mount portion 72. The housing mount portion 70 can include one or more mounting feet 74 that can define one or more features that are meant to secure the housing mount portion 70 to the plastic that forms the housing 12. In the example provided, the housing mount portion 70 includes a single mounting foot 74 that extends about the circumference of the securing structure 20, and the feature defined by the mounting foot 74 is an annular groove 76 that is formed in an outer circumferential surface of the housing mount portion 70. It will be appreciated, however, that the feature(s) in the mounting foot/feet could be configured somewhat differently. For example, the features in the mounting foot/feet could comprise holes 78 as shown in FIG. 7 that are formed radially through the mounting foot 74, or could comprise one or more convolved U-shaped bends 80 as shown in FIG. 8. Returning to FIGS. 1 and 2, the lid mount portion 72 can define an outer abutment surface 82 and a peripheral surface 84.

Figure 9:
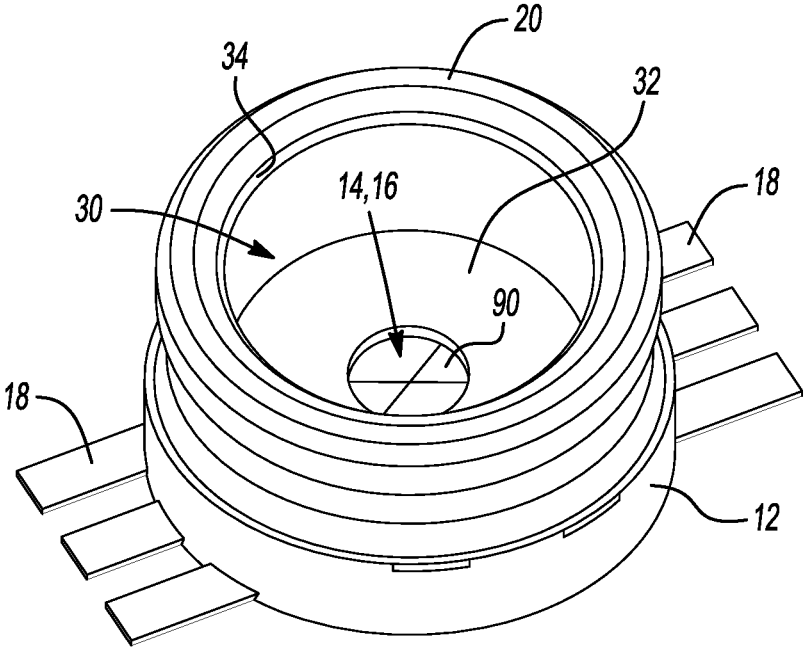
FIG. 9 is a perspective view of a portion of the initiation system depicting the housing as overmolded onto the initiator chip, the flyer layer and a plurality of initiator conductors.

With reference to FIGS. 2 and 9, the plastic material that forms the housing 12 can be overmolded onto the initiator chip 14, the flyer layer 16 and the initiator conductors 18 as well as the housing mount portion 70 of the securing structure 20. It will be appreciated that the overmolding technique permits the housing 12 to be cohesively bonded to the initiator chip 14, the flyer layer 16, the initiator conductors 18 and the housing mount portion 70. The initiator chip 14 can be located within the plastic material that forms the housing 12 proximate the first end 32 of the cavity 30, while the housing mount portion 70 can be located within the plastic material that forms the housing 12 proximate the second end 34 of the cavity 30. The housing 12 may be formed to fully or partly encapsulate the initiator chip 14 and may form a barrel 88 having a barrel aperture 90 with a first end, which abuts the flyer layer 16 at a location in-line with the bridge 42, and a second end that intersects the first end 32 of the cavity 30. Alternatively, the barrel 88 can be mounted to the initiator chip 14 prior to the forming of the housing 12. In situations where the barrel 88 is pre-mounted to the initiator chip 14, the barrel 88 can overlie the flyer layer 16 at a location where the barrel aperture 90 is in-line with the bridge 42. The second ends 52 of the initiator conductors 18 can extend through the housing 12. The plastic material that forms the housing 12 can be received into the feature(s) in the mounting foot/feet to fixedly couple the securing structure 20 to the housing 12 such that the securing structure 20 is disposed about the cavity 30 in the housing 12. For example, the plastic material that forms the housing 12 can be received through and fully fill the holes 78 in the housing mount portion 70 that is shown in FIG. 7. In the example provided, the plastic material that forms the housing 12 is received into the annular groove 76 and generates a compressive stress as it cools that is applied to the mounting foot 74. The plastic material that forms the housing 12 can cohesively bond to the housing mount portion 70 and form an airtight seal between the housing 12 and the securing structure 20. The lid mount portion 72 can extend away from the housing 12 (i.e., away from the second end 34 of the cavity 30) so that the outer abutment surface 82 and the peripheral surface 84 are clear of the plastic that forms the housing 12.

Figure 4A:
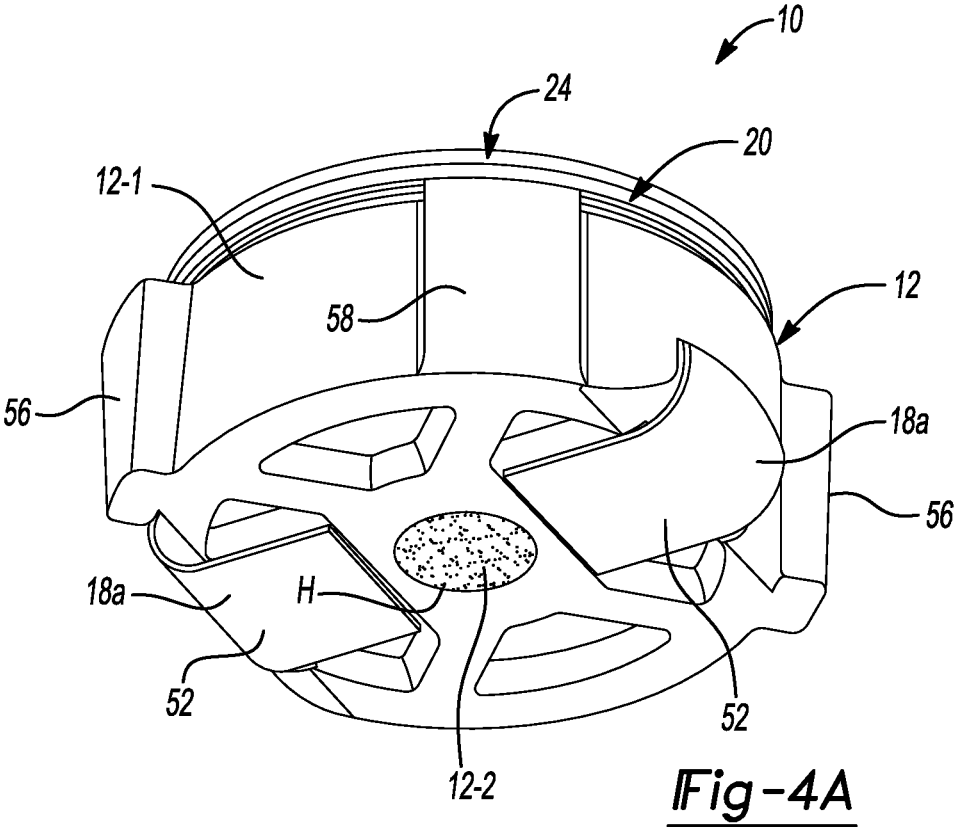
FIG. 4A is a perspective view similar to that of FIG. 4 but illustrating a housing of the initiation system as being formed in two distinct portions.
Figure 5A:
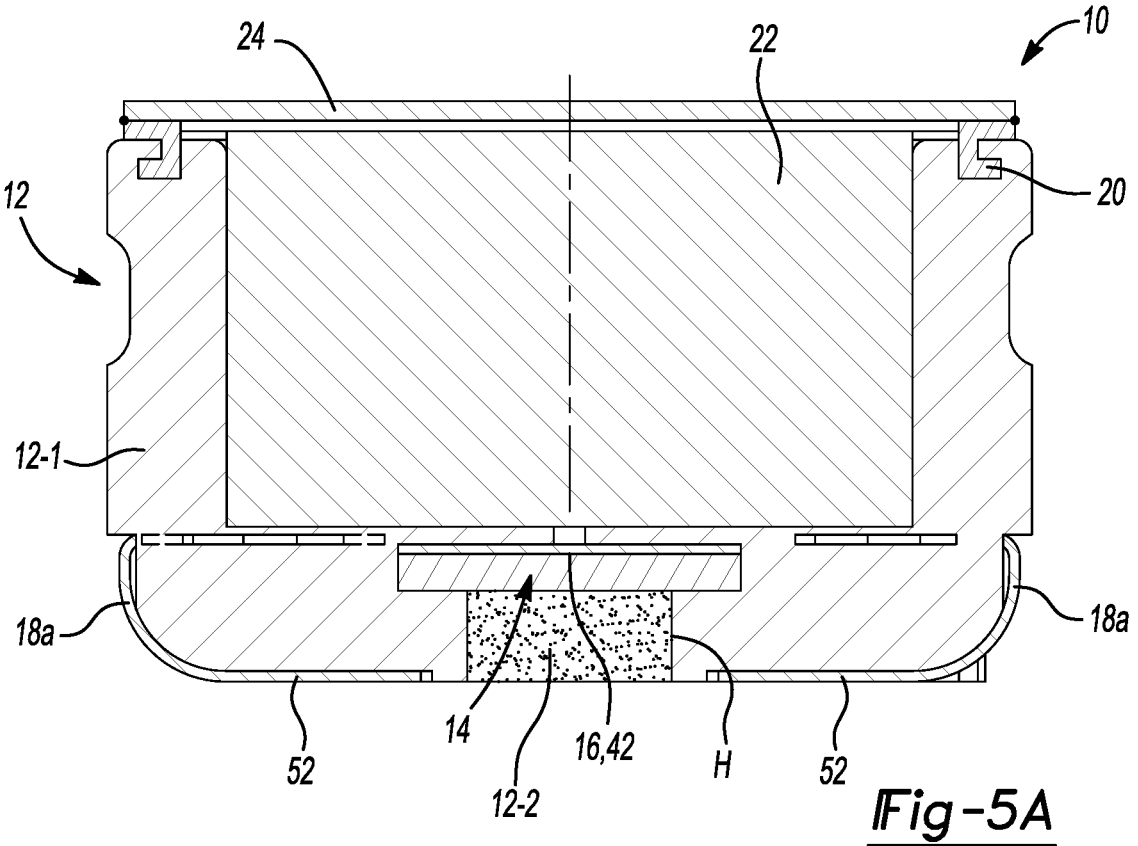
FIG. 5A is a section view similar to that of FIG. 5 but illustrating the housing as being formed in two distinct portions.

With reference to FIGS. 4A and 5A, it may be desirable to form the housing 12 in two parts: a first housing part 12-1 and a second housing part 12-2. The first housing part 12-1 can be identical to the housing 12 but can have a hole H that is positioned on a side of the initiator chip 14 that is opposite the barrel 88. The presence of the hole H permits the initiator chip 14 to be supported directly on the mold (not shown) that forms the first housing portion 12-1. The hole H in the first housing portion 12-1 can be filled or sealed in a suitable way (via the second housing portion 12-2) to ensure that the hole H does not affect the capability of the housing 12 to be hermetically sealed. For example, the second housing portion H could be a plastic material that is formed in a second molding operation to fill the hole H, or could be an epoxy material that can be employed to seal the perimeter of the hole H to the initiator chip 14 and to the first housing portion 12-1 can be filled to be hermetically sealed. If an epoxy or other adhesive is employed to form the second housing portion 12-2, it will be appreciated that the epoxy or other adhesive could be employed to partly or completely fill the hole H.

With reference to FIGS. 1 and 2, the input charge 22 can be formed of a suitable energetic material, such as a secondary explosive material, and can be received in the cavity 30 in the housing 12. One suitable secondary explosive material is RSI-007 manufactured by Reynolds Systems Incorporated of Middletown, Calif.

Figure 2A:
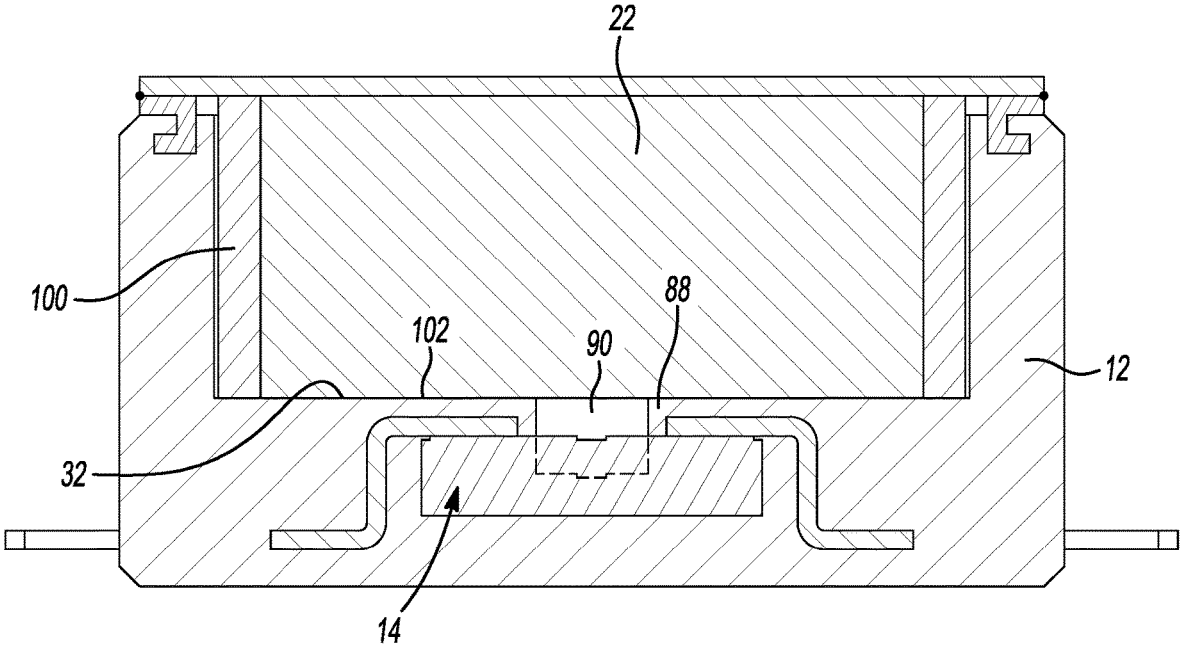
FIG. 2A is a section view similar to that of FIG. 2 but depicting a support sleeve and a barrier structure received in a cavity of a housing of the initiation system.

With reference to FIGS. 1 and 2A, the input charge 22 can be disposed in a support sleeve 100 if desired. The support sleeve 100 can be formed of a suitable material, such as steel, aluminum or tungsten, and both the support sleeve 100 and the input charge 22 can be received in the cavity 30 in the housing 12. Optionally, a barrier member 102 can be received in the cavity 30 and disposed between the second end of the barrel 88 and the input charge 22. The barrier member 102 can comprise one or more layers of a suitable material or materials, such as polytetrafluoroethylene or metal (e.g., a foil). The barrier member 102 can be employed for example to provide electric insulation, attenuate energy released by the initiator chip 14 (e.g., via vaporization of the bridge) when the initiator chip 14 is operated, and/or to inhibit or resist the infiltration of particles of the input charge 22 from migrating through the barrel 88 and onto the flyer layer 16. In situations where both a support sleeve 100 and a barrier member 102 are employed, the barrier member 102 can be secured (e.g., adhesively bonded, welded) to the support sleeve 100.

Returning to FIGS. 1 and 2, the lid 24 can be abutted to the outer abutment surface 82 of the lid mount portion 72 and can be fixedly and sealingly coupled to the securing structure 20 via a weld, such as a laser weld or an electron beam weld. In the example provided, a laser weld 110 is employed to form a continuous butt weld that fixedly and sealingly couples the peripheral surface 84 of the lid mount portion 72 to a peripheral surface 112 of the lid 24. It will be appreciated that in this example, where the housing mount portion 70 of the securing structure 20 is encapsulated in the plastic material that forms the housing 12 and the lid 24 is welded to the lid mount portion 72 permits the cavity 30 to be hermetically sealed, thus ensuring against the entry of moisture or air that may potentially degrade the input charge 22.

Figure 10:
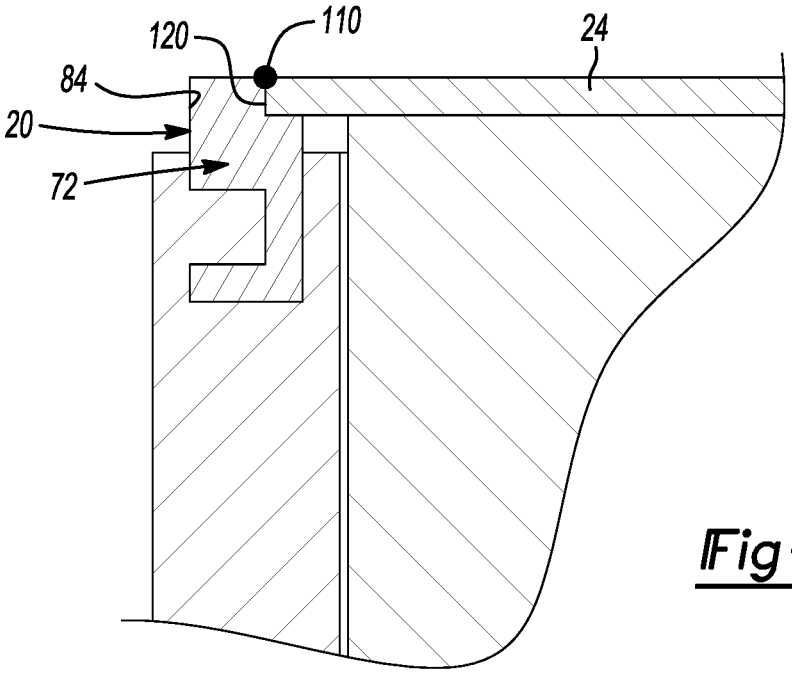
FIG. 10 is a section view of a portion of another initiation system having an alternately configured securing structure and lid.

It will be appreciated that the lid 24 can be fixedly and sealingly coupled to the lid mount portion 72 in various other manners, such as via a chemical or adhesive bond. With reference to FIG. 10, the lid mount portion 72 could define a counterbore 120 into which the lid 24 may be received, and a butt weld 110 could be employed to fixedly and sealingly secure the lid 24 to the lid mount portion 72 at a location that is radially inward of the outer peripheral surface 84 of the lid mount portion 72.

Figure 11:
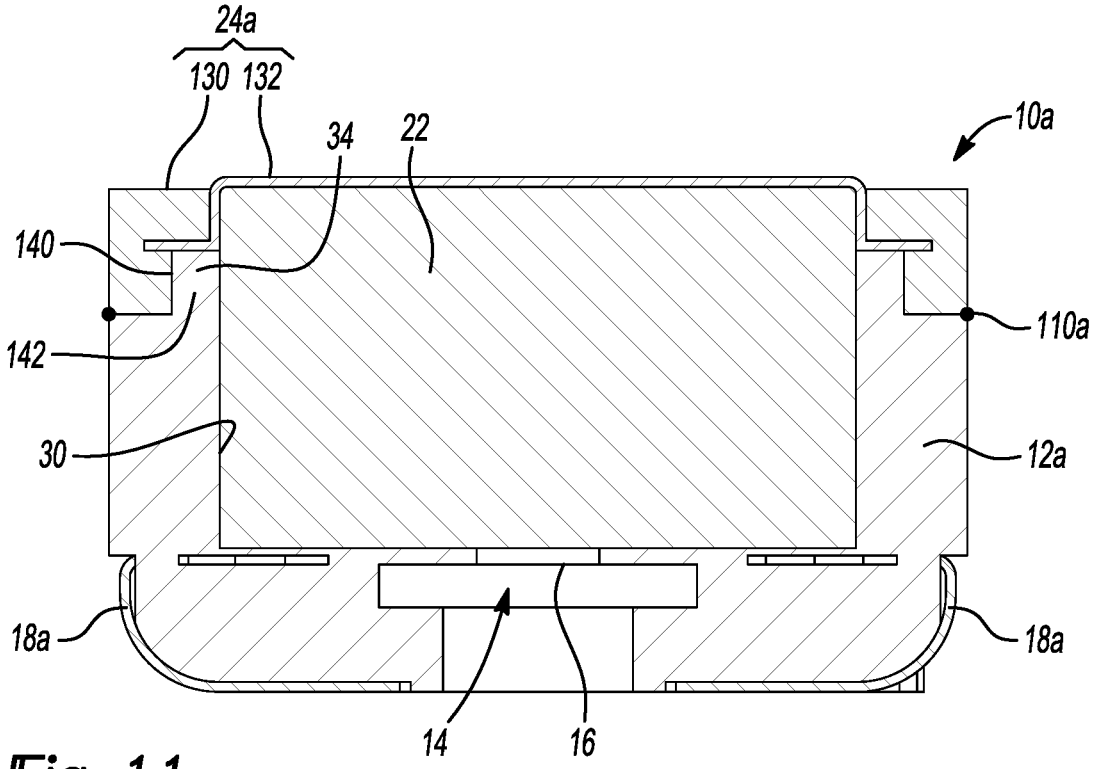
FIG. 11 is a section view of still another initiation system constructed in accordance with the teachings of the present disclosure.
Figure 12:
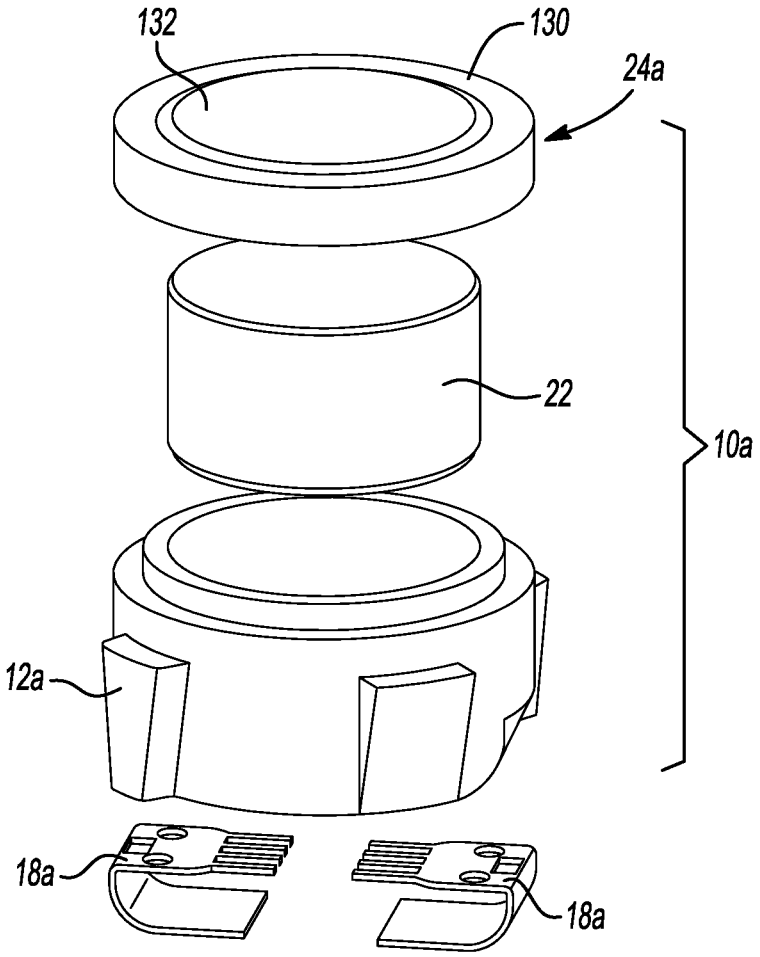
FIG. 12 is an exploded perspective view of the initiation system of FIG. 11.

While the initiation system 10 has been illustrated and described as including a securing structure 20, which is overmolded into a housing 12, and a lid 24 that is fixedly and sealingly coupled to the securing structure 20, it will be appreciated that the cavity 30 in the housing 12 can be hermetically sealed in somewhat different ways. In the example of FIGS. 11 and 12, the initiation system 10*a* can include a housing 12*a*, the initiator chip 14, the flyer layer 16, the plurality of initiator conductors 18*a*, the input charge 22 and a lid 24*a*. The housing 12*a* is identical to the housing 12 in the example of FIG. 1 except that a securing structure is not coupled to or partly encapsulated in the plastic material that forms the housing 12*a*. The lid 24*a* can be at least partly formed of a second plastic material, which could be identical to or different from the first plastic material that is used to form the housing 12*a*. The lid 24*a* can have a rim member 130 and a lid member 132. The housing 12*a* and the lid 24*a* can be formed with features that can aid in aligning the lid 24*a* to the housing 12*a*. In the example provided, a counterbore 140 is formed in the rim member 130 and is sized to receive an annular shoulder 142 formed on the housing 12*a*.

The rim member 130 can be fixedly and sealingly coupled to the housing 12*a* so that the lid 24*a* closes the second, open end 34 of the cavity 30. For example, a weld 110*a* can be employed to fixedly and sealingly couple the rim member 130 to the housing 12*a*. In the example provided, the weld 110*a* is formed on the peripheral surfaces of the housing 12*a* and the rim member 130. The rim member 130 can be welded to the second end 34 of the housing 12*a*, for example by laser welding, ultrasonic welding or friction welding. Alternatively, the rim member 130 can be adhesively bonded to the second end 34 of the housing 12*a* via an appropriate adhesive.

Figure 13:
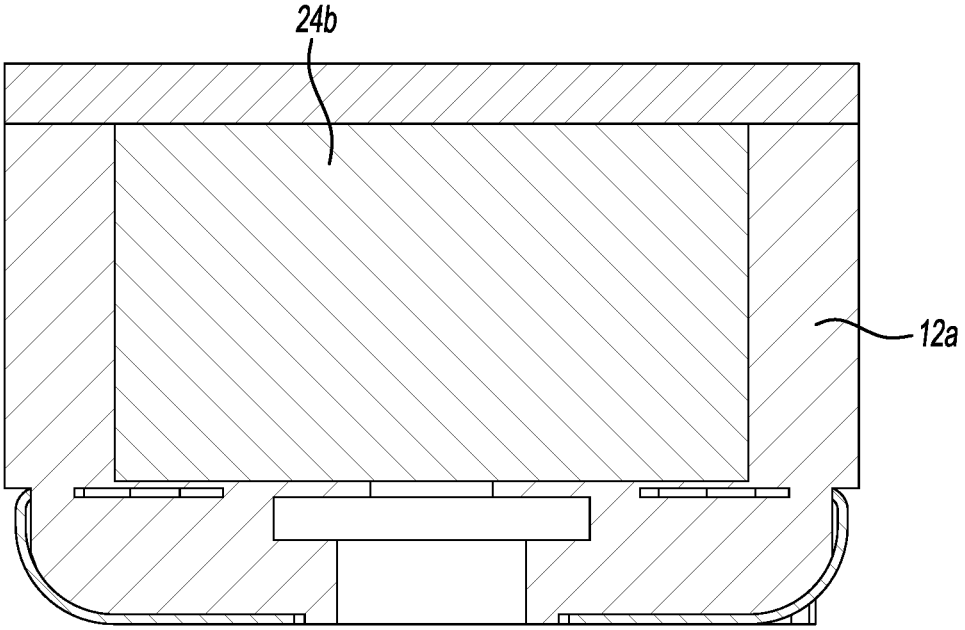
FIGS. 13 and 14 are section views similar to that of FIG. 11 but depicting alternately configured lids.
Figure 14:
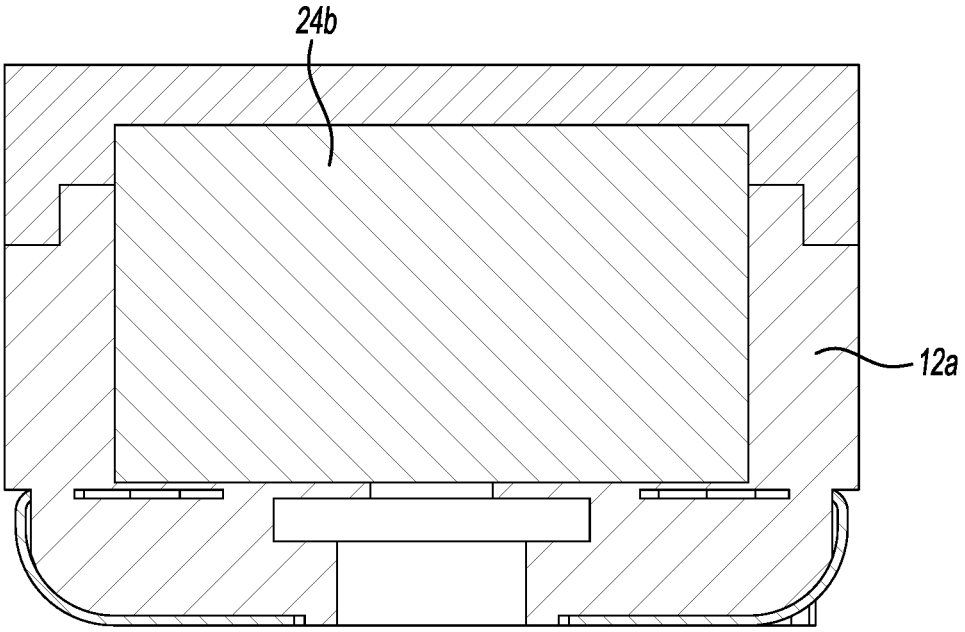

The lid member 132 can be formed of a suitable material, such as steel or aluminum, and can be at least partly encapsulated into the second plastic material that forms the rim member 130. In this regard, the second plastic material that forms the rim member 130 is overmolded onto the lid member 132 (e.g., around the perimeter of the lid member 132) so that the lid member 132 is cohesively bonded to the rim member 130. Alternatively, as shown in FIGS. 13 and 14, the lid member 24*b* can be unitarily and integrally formed of the second plastic material and can be welded or bonded to the housing 12*a* as described above.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A detonator comprising:

an initiator chip having an electrically conductive bridge;

a flyer layer coupled to the initiator chip and overlying the bridge;

a housing formed of a first plastic material, the plastic material being overmolded onto the initiator chip such that the initiator chip is at least partly encapsulated into the first plastic material to thereby fixedly couple the initiator chip to the housing, the housing defining a cavity having a first end and a second, open end that is opposite the first end, wherein the initiator chip is disposed proximate the first end of the cavity;

an energetic material disposed in the cavity, the energetic material comprising a secondary explosive material; and a lid at least partly formed of a second plastic material, the lid being abutted to the secondary explosive material and fixedly and sealingly coupled to the housing to close the open end of the cavity.

2. The detonator of claim 1, wherein the second plastic material of the lid is welded to the first plastic material of the housing.

3. The detonator of claim 2, wherein the lid is ultrasonically welded to the housing.

4. The detonator of claim 2, wherein the lid is laser welded to the housing.

5. The detonator of claim 2, wherein the lid is friction welded to the housing.

6. The detonator of claim 1, wherein the lid is adhesively bonded to the housing.

7. The detonator of claim 1, wherein the second plastic material of the lid is overmolded onto the housing such that the second plastic material of the lid is cohesively bonded to the housing.

8. An initiation system comprising:

an initiator chip having an electrically conductive bridge;

a flyer layer coupled to the initiator chip and overlying the bridge;

a housing formed of a first plastic material, the plastic material being overmolded onto the initiator chip such that the initiator chip is at least partly encapsulated into the first plastic material to thereby fixedly couple the initiator chip to the housing, the housing defining a cavity having a first end and a second, open end that is opposite the first end, wherein the initiator chip is disposed proximate the first end of the cavity;

an energetic material disposed in the cavity; and a lid at least partly formed of a second plastic material, the lid being fixedly and sealingly coupled to the housing to close the open end of the cavity;

wherein the lid includes a rim member, which is formed of the second plastic material, and a lid member, and wherein the rim member is overmolded onto the lid member such that the second plastic material of the rim member is cohesively bonded to the lid member.

9. The initiation system of claim 8, wherein the lid member spans across the rim member.

10. The detonator of claim 1, wherein the first plastic material of the housing also defines a barrel having a barrel aperture that is disposed in-line between the flyer layer and the energetic material.

11. The detonator of claim 1, further comprising a barrel coupled to the flyer layer and having a barrel aperture that is disposed in-line between the flyer layer and the energetic material.

12. The detonator of claim 1, wherein the first plastic material of the housing defines a plurality of lock features that permit the housing to be snap-fit to a secondary housing.

13. The detonator of claim 1, further comprising a pair of initiator conductors, each of the initiator conductors having a first end, which is mounted to a corresponding bridge contact on the initiator chip, and a second end, the first end being encapsulated in the plastic of the housing, the second end being disposed outside the housing.

14. The detonator of claim 13, wherein the second ends of the initiator conductors form electrically conductive springs.

15. A method for forming an initiation system comprising:

providing an assembly having an initiator chip and a flyer layer, the initiator chip having an electrically conductive bridge, the flyer layer being coupled to the initiator chip and overlying the bridge;

molding a housing from a first plastic material such that the housing defines a lid mount portion and a cavity, the cavity having a first end and a second, open end that is opposite the first end and which extends through the lid mount portion, wherein the initiator chip is at least partly encapsulated in the plastic material, wherein the bridge is disposed proximate the first end of the cavity;

inserting an energetic material into the cavity, the energetic material comprising a secondary explosive material;

providing a lid that is at least partly formed from a second plastic material; and mounting the lid to the lid mount portion to close the second end of the cavity, wherein the second plastic material of the lid is directly coupled to the first plastic material of the housing and wherein the lid abuts the secondary explosive material.

16. The method of claim 15, wherein the lid and the housing are welded to one another.

17. The method of claim 16, wherein the weld comprises at least one of a laser weld, an ultrasonic weld and a friction weld.

18. The method of claim 15, wherein the lid and the housing are bonded to one another.

19. The method of claim 15, wherein the lid comprises a lid member that is formed of a metal material.

20. The method of claim 19, wherein the second plastic material is cohesively bonded to the lid member.

21. The initiation system of claim 9, wherein the first plastic material of the housing also defines a barrel having a barrel aperture that is disposed in-line between the flyer layer and the energetic material.

* * * * *